US006666918B2

(12) United States Patent
Louks et al.

(10) Patent No.: US 6,666,918 B2
(45) **Date of Patent: *Dec. 23, 2003**

(54) ELECTROSTATICALLY ASSISTED COATING APPARATUS WITH FOCUSED WEB CHARGE FIELD

(75) Inventors: John W. Louks, St. Paul, MN (US); Nancy J. W. Hiebert, St. Paul, MN (US); Luther E. Erickson, St. Paul, MN (US); Peter T. Benson, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/206,113

(22) Filed: Jul. 26, 2002

(65) Prior Publication Data

US 2002/0187277 A1 Dec. 12, 2002

Related U.S. Application Data

(62) Division of application No. 09/544,368, filed on Apr. 6, 2000, now Pat. No. 6,475,572.

(51) Int. Cl.[7] ..... B05B 5/00; B05C 5/00

(52) U.S. Cl. ..... 118/626; 118/627; 118/636; 118/638

(58) Field of Search ..... 118/410, 636, 118/638, 640, 627, 626, 621, 623, 64, DIG. 4; 427/209, 471, 472, 420, 533, 536, 538, 600, 326, 428

(56) References Cited

U.S. PATENT DOCUMENTS

| | | | |
|---|---|---|---|
| 878,273 | A | 2/1908 | Chapman |
| 2,052,131 | A | 8/1936 | Chappell |
| 2,559,225 | A | 7/1951 | Ransburg |
| 2,685,536 | A | 8/1954 | Starkey et al. |
| 2,952,559 | A | 9/1960 | Nadeau |

(List continued on next page.)

FOREIGN PATENT DOCUMENTS

| | | | |
|---|---|---|---|
| CA | 851087 | A | 3/1970 |
| DE | 33 41 415 | A1 | 5/1984 |

(List continued on next page.)

OTHER PUBLICATIONS

Cohen, E.D. & Gutoff, E.B. "Modern Coating & Drying Technology", VCH Publishers, New York, 1992.

Satas, D. "Web Processing & Converting Technology & Equipment", Van Vorstrand Renhold Pub. Co., New York 1984.

*Primary Examiner*—Richard Crispino
*Assistant Examiner*—George R. Koch, III

(57) ABSTRACT

A system for applying a fluid coating onto a substrate includes forming a fluid wetting line by introducing a stream of fluid onto a first side of the substrate along a laterally disposed fluid-substrate contact area. An electrical force is created on the fluid from an electrical field (originating from electrical charges which are on the second side of the substrate) that is substantially at and downstream of the fluid wetting line. The electrical field can be generated by charges that have been transferred to the second side of the substrate from a remote charge generator.

17 Claims, 6 Drawing Sheets

U.S. PATENT DOCUMENTS 3,196,063 A 7/1965 Paquin et al.
3,206,323 A 9/1965 Miller et al.
3,223,757 A 12/1965 Owens et al.
3,268,766 A 8/1966 Amos et al.
3,335,026 A 8/1967 Geest et al.
3,363,108 A 1/1968 Spurr et al.
3,462,286 A 8/1969 Geest et al.
3,470,274 A 9/1969 Sandiford et al.
3,470,417 A 9/1969 Gibbons et al.
3,474,292 A 10/1969 Carter
3,489,082 A 1/1970 Morris et al.
3,531,314 A 9/1970 Kerr et al.
3,549,406 A 12/1970 Ambusk
3,566,110 A 2/1971 Henderson et al.
3,619,615 A 11/1971 Fish
3,652,897 A 3/1972 Iosue et al.
3,670,203 A 6/1972 Whitmore, Jr. et al.
3,671,806 A 6/1972 Whitmore et al.
3,697,303 A 10/1972 Busch et al.
3,702,258 A 11/1972 Gibbons et al.
3,711,312 A 1/1973 Yoshida et al.
3,716,755 A 2/1973 Marx
3,717,791 A 2/1973 Heyl et al.
3,729,648 A 4/1973 Kerr
3,730,753 A 5/1973 Kerr
3,757,163 A 9/1973 Gibbons et al.
3,757,164 A 9/1973 Binkowski
3,787,706 A 1/1974 Geest
3,790,854 A 2/1974 Dryczynski et al.
3,818,545 A 6/1974 Olson et al.
3,867,901 A * 2/1975 Greiller ..... 118/50
3,871,980 A 3/1975 Butcher
3,887,843 A 6/1975 Richardson et al.
3,921,037 A 11/1975 Testone
4,007,576 A 2/1977 Metz
4,012,666 A 3/1977 Schramm et al.
4,027,201 A 5/1977 Bacon et al.
4,110,810 A 8/1978 Moore et al.
4,130,852 A 12/1978 Peffer et al.
4,218,493 A 8/1980 Rarey
4,363,070 A 12/1982 Kisler
4,383,752 A 5/1983 Kisler
4,402,035 A 8/1983 Kisler
4,457,256 A 7/1984 Kisler et al.
4,486,808 A 12/1984 Cardone
4,489,672 A 12/1984 Kisler
4,513,683 A 4/1985 Kisler
4,517,143 A 5/1985 Kisler
4,676,190 A 6/1987 Spengler
4,729,945 A 3/1988 Anthonsen et al.
4,826,703 A 5/1989 Kisler
4,835,004 A 5/1989 Kawanishi
4,837,045 A 6/1989 Nakajima
4,990,359 A 2/1991 Knobbe
4,999,733 A 3/1991 Kakuda
5,041,941 A 8/1991 Carter et al.
5,122,386 A 6/1992 Yoshida
5,138,971 A 8/1992 Nakajima et al.
5,290,600 A 3/1994 Ord et al.
5,295,039 A 3/1994 Nakajima et al.
5,331,503 A 7/1994 McGarry et al.
5,336,534 A 8/1994 Nakajima et al.
5,340,616 A 8/1994 Amano et al.
5,420,743 A 5/1995 Domes
5,432,454 A 7/1995 Durkin
5,609,923 A 3/1997 Clarke
5,641,544 A * 6/1997 Melancon et al. ..... 427/331
6,171,658 B1 1/2001 Zaretsky et al.

FOREIGN PATENT DOCUMENTS

EP 0 055 985 7/1982
EP 0 285 794 B1 9/1991
EP 398774 B1 7/1992
EP 0 530 752 A1 3/1993
EP 0 728 532 A1 8/1996
EP 0 762 810 A1 3/1997
FR 2 296 958 7/1976
GB 1 487 307 9/1977
GB 2324054 10/1998
JP 04627423 8/1971
JP 01069324 3/1989
JP 01222923 9/1989
JP 03053498 3/1991
JP 04028524 1/1992
JP 04070312 3/1992
JP 04077230 3/1992
JP 04083627 3/1992
JP 05286019 11/1993
JP 08064384 3/1996
JP 09001044 1/1997
WO WO 89/05477 6/1989
WO WO 92/11095 7/1992
WO WO 92/11572 7/1992
WO WO 92/12612 7/1992
WO WO 96/09124 3/1996

* cited by examiner

ELECTROSTATICALLY ASSISTED COATING APPARATUS WITH FOCUSED WEB CHARGE FIELD

CROSS REFERENCE TO RELATED APPLICATION(S)

This application is a divisional of U.S. application Ser. No. 9/544,368 filed Apr. 6, 2000, now U.S. Pat. No. 6,475,572 B2 entitled "ELECTROSTATICALLY ASSISTED COATING METHOD AND APPARATUS WITH FOCUSED WEB CHARGE FIELD" by John W. Louks, Nancy J. W. Hiebert, Luther E. Erickson and Peter T. Benson.

BACKGROUND OF THE INVENTION

Coating is the process of replacing the gas contacting a substrate, usually a solid surface such as a web, by one or more layers of fluid. A web is a relatively long flexible substrate or sheet of material, such as a plastic film, paper or synthetic paper, or a metal foil, or discrete parts or sheets. The web can be a continuous belt. A coating fluid is functionally useful when applied to the surface of a substrate. Examples of coating fluids are liquids for forming photographic emulsion layers, release layers, priming layers, base layers, protective layers, lubricant layers, magnetic layers, adhesive layers, decorative layers, and coloring layers.

After the deposition, a coating can remain a fluid such as in the application of lubricating oil to metal in metal coil processing or the application of chemical reactants to activate or chemically transform a substrate surface. Alternatively, the coating can be dried if it contains a volatile fluid to leave behind a solid coat such as a paint, or can be cured or in some other way solidified to a functional coating such as a release coating to which a pressure-sensitive adhesive will not aggressively stick. Methods of applying coatings are discussed in Cohen, E. D. and Gutoff, E. B., Modern Coating and Drying Technology, VCH Publishers, New York 1992 and Satas, D., Web Processing and Converting Technology and Equipment, Van Vorstrand Reinhold Publishing Co., New York 1984.

The object in a precision coating application is typically to uniformly apply a coating fluid onto a substrate. In a web coating process, a moving web passes a coating station where a layer or layers of coating fluid is deposited onto at least one surface of the web. Uniformity of coating fluid application onto the web is affected by many factors, including web speed, web surface characteristics, coating fluid viscosity, coating fluid surface tension, and thickness of coating fluid application onto the web.

Electrostatic coating applications have been used in the printing and photographic areas, where roll and slide coating dominate and lower viscosity conductive fluids are used. Although the electrostatic forces applied to the coating area can delay the onset of entrained air and result in the ability to run at higher web speeds, the electrostatic field that attracts the coating fluid to the web is fairly broad. One known method of applying the electrostatic fields employs precharging the web (applying charges to the web before the coating station). Another known method employs an energized support roll beneath the web at the coating station. Methods of precharging the web include corona wire charging and charged brushes. Methods of energizing a support roll include conductive elevated electrical potential rolls, nonconductive roll surfaces that are precharged, and powered semiconductive rolls. While these methods do deliver electrostatic charges to the coating area, they do not present a highly focused electrostatic field at the coater. For example, for curtain coating with a precharged web, the fluid is attracted to the web and the equilibrium position of the fluid/web contact line (wetting line) is determined by a balance of forces. The electrostatic field pulls the coating fluid to the web and pulls the coating fluid upweb. The motion of the web creates a force which tends to drag the wetting line downweb. Thus, when other process conditions remain constant, higher electrostatic forces or lower line speeds result in the wetting line being drawn upweb. Additionally, if some flow variation exists in the crossweb flow of the coating fluid, the lower flow areas are generally drawn further upweb, and the higher flow areas are generally drawn further downweb. These situations can result in decreased coating thickness uniformity. Also, process stability is less than desired because the wetting line is not stable but depends on a number of factors.

There are many patents that describe electrostatically-assisted coating. Some deal with the coating specifics, others with the charging specifics. The following are some representative patents. U.S. Pat. No. 3,052,131 discloses coating an aqueous dispersion using either roll charging or web precharging, U.S. Pat. No. 2,952,559 discloses slide coating emulsions with web precharging, and U.S. Pat. No. 3,206,323 discloses viscous fluid coating with web precharging.

U.S. Pat. No. 4,837,045 teaches using a low surface energy undercoating layer for gelatins with a DC voltage on the backup roller. A coating fluid that can be used with this method include a gelatin, magnetic, lubricant, or adhesive layer of either a water soluble or organic nature. The coating method can include slide, roller bead, spray, extrusion, or curtain coating.

EP 390774 B1 relates to high speed curtain coating of fluids at speeds of at least 250 cm/sec (492 ft/min), using a pre-applied electrostatic charge, and where the ratio of the magnitude of charge (volts) to speed (cm/sec) is at least 1:1.

U.S. Pat. No. 5,609,923 discloses a method of curtain coating a moving support where the maximum practical coating speed is increased. Charge may be applied before the coating point or at the coating point by a backing roller. This patent refers to techniques for generating electrostatic voltage as being well known, suggesting that it is referring to the listed examples of a roll beneath the coating point or previous patents where corona charging occurs before coating. This patent also discloses corona charging. The disclosed technique is to transfer the charge to the web with a corona, roll, or bristle brush before the coating point to set up the electrostatic field on the web before the coating is added.

FIGS. 1 and 2 show known techniques for electrostatically assisting coating applications. In FIG. 1, a web 20 moves longitudinally (in the direction of arrows 22) past a coating station 24. The web 20 has a first major side 26 and a second major side 28. At the coating station 24, a coating fluid applicator 30 laterally dispenses a stream of coating fluid 32 onto the first side 26 of the web 20. Accordingly, downstream from the coating station 24, the web 20 bears a coating 34 of the coating fluid 32.

In FIG. 1, an electrostatic coating assist for the coating process is provided by applying electrostatic charges to the first side 26 of the web 20 at a charge application station 36 spaced longitudinally upstream from the coating station 24 (the charges could alternatively be applied to the second side 28 of the web 20). At the charge application station 36, a laterally disposed corona discharge wire 38 applies positive (or negative) electrical charges 39 to the web 20. The wire 38 can be on either the first or second side of the web 20. The coating fluid 32 is grounded (such as by grounding the coating fluid applicator 30), and is electrostatically attracted to the charged web 20 at the coating station 24. A laterally disposed air dam 40 can be disposed adjacent and upstream of the coating station 24 to reduce web boundary layer air interference at the coating fluid-web interface 41. The corona wire could be aligned in free space along the web (as shown in FIG. 1) or alternatively, could be aligned adjacent the first side of the web while the web is in contact with a backing roll at the coating station.

FIG. 2 shows another known electrostatically assisted coating system. In this arrangement, a relatively large diameter backing roll 42 supports the second side 28 of the web 20 at the coating station 24. The backing roll 42 can be a charged dielectric roll, a powered semiconductive roll, or a conductive roll. The conductive and semiconductive rolls can be charged by a high voltage power supply. With a dielectric roll, the roll can be provided with electrical charges by suitable means, such as a corona charging assembly 43. Regardless of the type of backing roll 42 or its means of being charged, its outer cylindrical surface 44 is adapted to deliver the electrical charges 39 to the second side 28 of the web 20. As shown in FIG. 2, the electrical charges 39 from the backing roll 42 are positive charges, and the coating fluid 32 is grounded by grounding the coating fluid applicator 30. Accordingly, the coating fluid 32 is electrostatically attracted to charges residing at the interface between the web 20 and the outer cylindrical surface 44 of the roll 42. The air dam 40 reduces web boundary layer air interference at the coating fluid-web interface 41.

Known electrostatically assisted coating arrangements such as those shown in FIGS. 1 and 2 assist the coating process by delaying the onset of air entrainment and improving the wetting characteristics at the coating wetting line. However, they apply charges to the web at a location substantially upstream from the wetting line, and generate fairly broad electrostatic fields. They are largely ineffective in maintaining a straight wetting line when there are cross-web coating flow variations or cross-web electrostatic field variations. For instance, in a curtain coater, if a localized heavy coating fluid flow area occurs somewhere across the curtain, the wetting line in this heavier coating region can move downweb in response, depending on the material and process parameters. This can create an even heavier coating in this area due to stress and strain on the curtain, especially for fluids which exhibit elastic characteristics (more elastic fluids have high extensional viscosity in relation to shear). In addition, if the electrostatic field is not uniform (e.g., there is a corona web precharge non-uniformity), the lower voltage area on the web will allow the wetting line in that area to move downweb, thus increasing the coating weight in that area. These effects become increasingly dominant as fluid elasticities increase. Thus, crossweb fluid flow variations and crossweb electrostatic field variations cause non-uniformity in the wetting line and, as a result, the application of a non-uniform coating on the web.

None of the known apparatus or methods for electrostatically assisted coating discloses a technique for applying a focused electrical field to the web at the coating station from an electrical field applicator to improve the characteristic of the applied fluid coating and also to attain improved processing conditions. There is a need for an electrostatically assisted coating technique that applies a more focused electrical field to the web at the coating station.

BRIEF SUMMARY OF THE INVENTION

The invention is a method of applying a fluid coating onto a substrate. The substrate has a first surface and a second surface. The method includes providing relative longitudinal movement between the substrate and a fluid coating station and forming a fluid wetting line by introducing, at an angle of from 0 degrees through 180 degrees, a stream of fluid onto the first side of the substrate along a laterally disposed fluid-web contact area at the coating station. An electrical force is created on the fluid from an electrical field originating from electrical charges which are on the second side of the substrate substantially at and downstream of the fluid wetting line.

The electrical force can be created by transferring the electrical charges through a fluid medium (e.g., air) and depositing the electrical charges onto the second surface of the substrate, or transferring electrical charges from a charge source and depositing the electrical charges onto the second surface of the substrate using physical contact between a portion of the charge source and the substrate, or both. When a fluid medium is used, the electrical charges can be transferred from a laterally extending corona discharge source closely spaced from the second surface of the substrate at the fluid coating station. The transfer of electrical charges upstream from the fluid wetting line can be further limited by providing an electrical barrier for shielding upweb portions of the web from the electrical charges. The substrate can be supported, adjacent the fluid coating station, on the second surface thereof.

In one embodiment, the electrical charges are formed as first charges at a location distant from the substrate, transferred to a laterally disposed charge application zone adjacent the second surface of the substrate at the fluid wetting line, and applied onto the second surface of the substrate at a location on the substrate that is substantially at and downstream of the fluid wetting line to create an electrical force on the fluid.

The stream of fluid can be formed with a coating fluid dispenser such as a curtain coater, a bead coater, an extrusion coater, carrier fluid coating methods, a slide coater, a knife coater, a jet coater, a notch bar, a roll coater or a fluid bearing coater. The stream of fluid can be tangentially introduced onto the first surface of the substrate.

The electrical charges can have a first polarity and the method can include applying second opposite polarity electrical charges to the fluid.

In another embodiment, the method of applying a fluid coating onto a substrate (where the substrate has a first surface on a first side thereof and a second surface on a second side thereof) includes providing relative longitudinal movement between the substrate and a fluid coating station. The method further includes forming a fluid wetting line by introducing, at a angle of 0 degrees through 180 degrees, a stream of coating fluid onto the first surface of the substrate along a laterally disposed fluid-web contact area at the coating station. The method further includes exposing effective electrostatic charges on the substrate to the fluid only at a location on the substrate that is substantially at and downstream of the fluid wetting line.

In this inventive method, the exposing step can further comprise depositing the electrical charges onto one of the first or second sides of the substrate at a location upweb from the fluid coating station. The exposing step can further include rendering the electrical charges ineffective as electrostatic charges relative to the fluid until the electrical charges are at least substantially at the fluid wetting line.

In one preferred embodiment, the exposing step of the inventive method further includes applying electrical charges to the substrate upweb from the fluid wetting line, and masking any effective electrostatic attractive forces between the electrical charges on the web and the fluid until the electrical charges are at least substantially at the fluid wetting line.

In a preferred embodiment, the electrical charges are applied to the first surface of the substrate and the masking step further comprises providing a grounded surface adjacent and spaced from the second surface of the substrate, with the grounded surface extending along the substrate from a trailing edge just upweb of the fluid wetting line to a leading edge spaced upweb further therefrom.

The invention is also an apparatus for applying a coating fluid onto a substrate which has a first surface on a first side thereof and a second surface on a second side thereof and is moved longitudinally relative to the apparatus. The apparatus includes means for dispensing a stream of coating fluid onto the first surface of the substrate to form a fluid wetting line along a laterally disposed fluid-web contact area and an electrical charge applicator extending laterally across the second side of the substrate. The electrical charge applicator is aligned generally opposite the fluid wetting line on the first surface of the substrate to charge the substrate at a location on the substrate that is substantially at and downstream of the fluid wetting line.

The electrical charge applicator can include a laterally extending charged wire, a sharp-edged member, a sharp-edged conductive sheet, a series of needles, a brush, or a jagged knife edge.

The electrical charge applicator can include an electrical charge source, for producing electrical charges as first electrical charges, distant from the second surface of the substrate, and a fluid medium. The fluid medium is disposed between the electrical charge source and the second surface of the substrate to transfer the first electrical charges from the electrical charge source to a laterally disposed charge application zone adjacent the second surface of the substrate at the fluid wetting line and to apply the first electrical charges onto the second surface of the substrate. The electrical charge applicator can be uniformly spaced from the second surface of the substrate.

An air bearing can extend laterally across the substrate adjacent the electrical charge applicator for supporting and aligning the second side of the substrate relative to the electrical charge applicator. An electrostatic field barrier can be disposed near the electrical charge applicator and the substrate to shield portions of the web upstream from the fluid wetting line from electrical charges from the electrical charge applicator.

Electrical charges from the electrical charge applicator can have a first polarity, and charges having a second, opposite polarity can be applied to the coating fluid.

The inventive method is also defined as a method of applying a fluid coating onto a substrate, where the substrate has a first side and a second side. The inventive method includes providing relative longitudinal movement between the substrate and a fluid coating station. A stream of fluid is introduced, at an angle of 0 degrees through 180 degrees, onto the first side of the substrate to form a fluid wetting line along a laterally disposed fluid-web contact area at the coating station. The invention further includes attracting the fluid to the first side of the substrate at a location on the substrate that is substantially at and downstream of the fluid wetting line by electrical forces from an effective electrical field originating at a location on the second side of the substrate.

Figure 1:
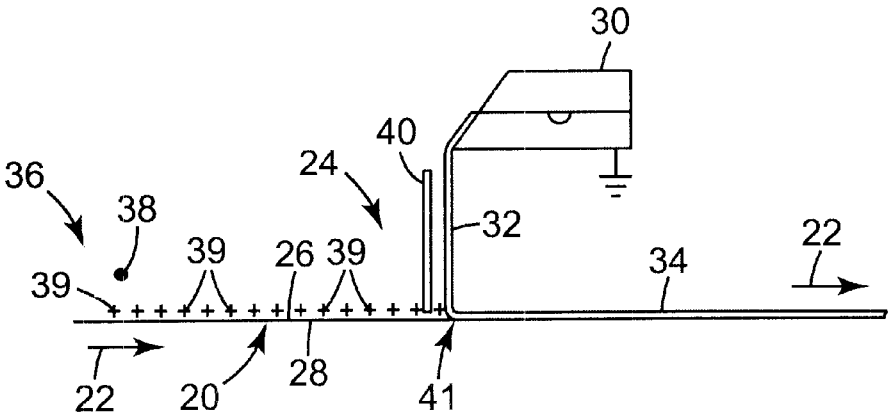
Fig. 1 PRIOR ART
FIG. 1 is a schematic view of a known electrostatic coating apparatus where charges are applied to the moving web before it enters a coating station from an upweb corona wire.

While some of the above-identified drawing figures set forth preferred embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

This invention includes an apparatus and coating method which use more focused electrostatic fields at the interface between a substrate (such as a web) to be coated and a fluid coating material applied on the substrate. The inventors have found that more focused electrostatic fields can improve the coating process by stabilizing, straightening and dictating the position of the coating wetting line, allowing wider process windows to be achieved. For example, the invention makes possible a wider range of coating weights, coating speeds, coating geometries, web features such as dielectric strengths, coating fluid characteristics such as viscosity, surface tension, and elasticity, and die-to-web gaps, as well as improving cross web coating uniformity. In addition, for conductive fluids, much lower energy systems (lower current) can be used as compared to systems using elevated potential conductive rolls. For low dielectric strength webs such as paper, higher voltages and coating speeds may be used without dielectric breakdown of the web. With curtain coating, electrostatic coating assist allows lower curtain heights (and therefore, greater curtain stability) and allows the coating elastic solutions which could not previously be coated without entrained air. Focused fields greatly enhance the ability to run coating fluids (especially elastic fluids) since they more precisely dictate the position, linearity, and stability of the wetting line, which results in increased process stability. In addition, thinner coatings than were previously possible can be produced, even at lower line speeds, which is important for processes that are drying or curing rate limited.

With extrusion coating it has been found that electrostatics permits the use of lower elasticity waterbased fluids (such as some waterbased emulsion adhesives) that cannot be extrusion coated absent the electrostatics (in the extrusion mode), as well as permitting the use of larger coating gaps.

In curtain coating, the stream of fluid is aligned with the gravitational vector, while in extrusion coating it can be aligned with the gravitational vector or at other angles. While coating with a curtain coating process, where longer streams of fluid are used, the coating step involves the displacing of the boundary layer air with coating fluid and the major force is momentum based. In contrast, with extrusion coating, where the stream of fluid is typically shorter than for curtain coating, the major forces are elasticity and surface tension related. When using electrostatics an additional force results which can assist in displacing the boundary layer air, or can become the dominant force itself.

Although the invention is described with respect to smooth, continuous coatings, the invention also can be used while applying discontinuous coatings. For example, electrostatics can be used to help coat a substrate having a macrostructure such as voids which are filled with the coating, whether or not there is continuity between the coating in adjacent voids. In this situation, the coating uniformity and enhanced wettability tendencies are maintained both within discrete coating regions, and from region to region.

The substrate can be any surface of any material that is desired to be coated, including a web. A web can be any sheet-like material such as polyester, polypropylene, paper, knit, woven or nonwoven materials. The improved wettability of the coating is particularly useful in rough textured or porous webs, regardless of whether the pores are microscopic or macroscopic. Although the illustrated examples show a web moving past a stationary coating applicator, the web can be stationary while the coating applicator moves, or both the web and coating applicator can move relative to a fixed point.

Generically speaking, the invention relates to a method of applying a fluid coating onto a substrate such as a web and includes providing relative longitudinal movement between the web and a fluid coating station. A stream of coating fluid is introduced onto the first side of the web along a laterally disposed fluid wetting line at a coating station. The coating fluid is introduced at any angle of from 0 degrees through 180 degrees. An electrical force is created on the fluid from an electrical field originating from charges which are located on the second side of the web and at a location on the web that is substantially at and downstream of the fluid wetting line. The electrical field can be generated by charges that have been transferred by any method and deposited on the second side of the web. The charges can be transferred to the second side of the web through a fluid medium or by direct contact. Negative or positive electrical charges may be used to attract the coating fluid. The coating fluid can include solvent-based fluids, thermoplastic fluid melts, emulsions, dispersions, miscible and immiscible fluid mixtures, inorganic fluids, and 100% solids fluids. Solvent-based coating fluids include solvents that are waterbased and also organic in nature. Certain safety precautions must be taken when dealing with volatile solvents, for example that are flammable, because static discharges can create hazards, such as, fires or explosions. Such precautions are known, and could include using an inert atmosphere in the region where static discharges might occur.

Instead of precharging the web or using an energized support roll system, as are known, one preferred embodiment of the invention uses a focused source of electrical charges, such as a narrow conductive electrode extending linearly in the cross-web direction where the wetting line should occur, on the side of the web opposite the coating fluid. For curtain coating applications, the desired wetting line is typically the gravity-determined coating fluid wetting line (with no electrostatics applied) when the web is stationary (or initial coating fluid wetting line (with no electrostatics applied) when the web is stationary). The narrow conductive electrode could be, for example, a continuous corona wire (such as corona wire 50 in FIG. 3), discretely spaced needle points, a brush, or any member with a sharp edge that can generate a corona discharge. The high electrostatic field gradient near the narrow electrode creates a corona discharge from the electrode, with the charges migrating towards the conductive coating fluid, but being stopped by the dielectric barrier of the web. The source of electrical charges may also be remotely located with charges subsequently being transferred to the backside of the web and focused substantially at or downstream of the wetting line. Alternatively, the charges can be directly deposited to the backside of the web from a solid structure contacting the backside of the web such as, for example, a brush, a conductive film, or a member with a small radius portion. Again, the charges are focused substantially at or downstream of the wetting line. These charges on the backside of the web create a more focused electrical field than prior electrostatic assisted coating systems. Because the field does not extend as far upweb (as was the case in known precharged web or energized coating roll systems), the coating fluid is drawn to the more sharply defined wetting line, retains a more linear crossweb profile, and stabilizes the wetting line by tending to lock it into position. This means that the normal balance of forces that dictate the wetting line position are less important, and that non-linearities in the wetting line are less pronounced. Thus, process variations, such as coating flow rates, coating crossweb uniformity, web speed variations, incoming web charge variations, and other process variations, have less effect on the coating process.

An additional benefit when a non-contacting electrostatic charge application system of the present invention (e.g., such as in FIG. 3), is that this system works well with lower dielectric strength webs and with conductive coating fluids. With systems, such as high potential conductive rolls used with conductive fluids, prior art electrostatic coating assist current flows that are higher than necessary to create the desired attractive force can occur because the roll is close to the web surface. This necessitates higher energy systems and creates greater shock hazards. In addition, arcing from the electrode through the web to the coating fluid is more likely to occur, especially for lower dielectric strength materials. With a noncontacting system where the focused web charges are created by transferring charges through a fluid medium (e.g., air) to the second side of the web, lower current is required and less arcing from the electrode to the coating fluid occurs. This results in a safer system and one that can run at higher web speeds. Typically, the electrode-to-web gap is from 0.08 cm to 7.6 cm (0.031 inch–3 inch), and more preferably in the range of 1.58 cm to 1.9 cm (0.625 inch to 0.75 inch). Closer gaps can increase aggressiveness and larger gaps (e.g., 1–3 inches (2.5–7.6 cm)) can further reduce arcing and enhance the ability to run low dielectric strength materials.

Figure 3:
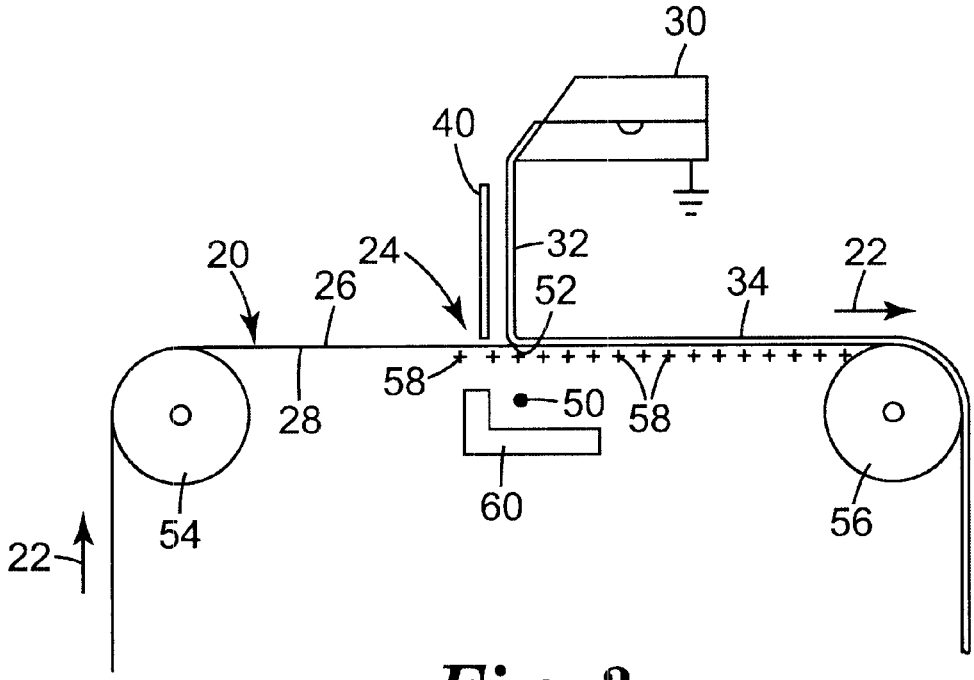
FIG. 3 is a schematic view of one embodiment of the electrostatically assisted coating apparatus of the present invention where a corona source applies charges to the moving web at the coating station.

FIG. 3 illustrates an embodiment of the inventive electrostatically assisted coating apparatus using a focused web charge field which can achieve better aggressiveness (i.e., coating fluid-web attraction at the desired wetting line location) and wetting line linearity than known arrangements. The inventors found that by distancing the electrode from the web and using small diameter wires such that the electrode acts as a corona wire, the field can remain focused while arcing and current flows are reduced. In this case, the field emanating from the wire itself does not create the main attractive force on the coating fluid. The main force is from corona charges from the wire that are transferred, though the air or other connecting medium, to the backside of the web and congregate at the wetting line. These charges on the backside of the web create the strong attractive force on the coating fluid. Also the charges from the wire do not tend to be attracted to the web substantially upweb of the wetting line, because the primary attraction is to the coating fluid at the wetting line. The field can become more highly focused by providing barriers or shaping fields to limit the flow of charges either upweb or downweb from the desired wetting line.

In the arrangement illustrated in FIG. 3, a laterally extending corona discharge wire 50 is spaced from the second side 28 of the web 20, longitudinally close to the coating station 24 that includes the lateral coating wetting line 52. The web 20 is supported at the coating station 24 between a pair of support rolls 54, 56. Alternatively, the web 20 can be supported at the coating station 24 by support panels, slides, tracks, or other supports. The air dam 40 can be any suitable physical barrier which limits ambient air interference at the wetting line. FIG. 3 exhibits the inventive method with a curtain coating operation, but it is also functional with other coating geometries.

A stream of coating fluid 32 is delivered from the coating fluid applicator 30 onto a first surface on the first side 26 of the web 20. As shown, the coating fluid applicator 30 can be grounded, to ground the coating fluid 32 relative to the electrical charges 58 applied to the web 20 by the corona discharge wire 50. Alternatively, an opposite electrical charge can be applied to the coating fluid 32 such as by a suitable electrode device; also the applied polarities of the electrical charges to the coating fluid 32 and web 20 can be reversed. This method can be particularly useful when using lower electrical conductivity coating fluids. For example, for a low conductivity coating fluid, charges can be applied to the coating fluid before coating, whether through the die or by a corona. This system can be utilized when insufficient electrostatic aggressiveness is seen due to the use of low conductivity coating fluids. For a conductive coating fluid where the conductive path is isolated, the die potential can be raised to create the opposite polarity in the coating fluid. Alternatively, the opposite polarity can be applied to the coating fluid anywhere along the conductive, isolated path.

When activated, the corona discharge wire 50 applies electrical charges 58 to the second side 28 of the web 20. In one embodiment, an upstream side shield 60 extends laterally adjacent the corona discharge wire 50 to help prevent discharged ions from being attracted to the second side 28 of the web 20 upstream from the coating wetting line 52. The upstream side shield 60 can be formed from a nonconductive or insulating material, such as Delrin™ acetal resin made by E.I. du Pont de Nemours of Wilmington, Del. or from a semiconductive or conductive material held at ground potential or an elevated potential. The upweb side shield 60 is formed in any shape to achieve the desired electrical barrier for shielding upweb portions of the web 20 from the electrical charges of the corona discharge wire 50. A downweb shield can also be used, which can reduce excessive charge transfer downweb. Up web and downweb shields are preferably spaced equidistant from the wire, although other spacings can be functional. Although a physical barrier type shield is shown, other types of shields can be used, such as a counteracting electrostatic field.

Figure 2:
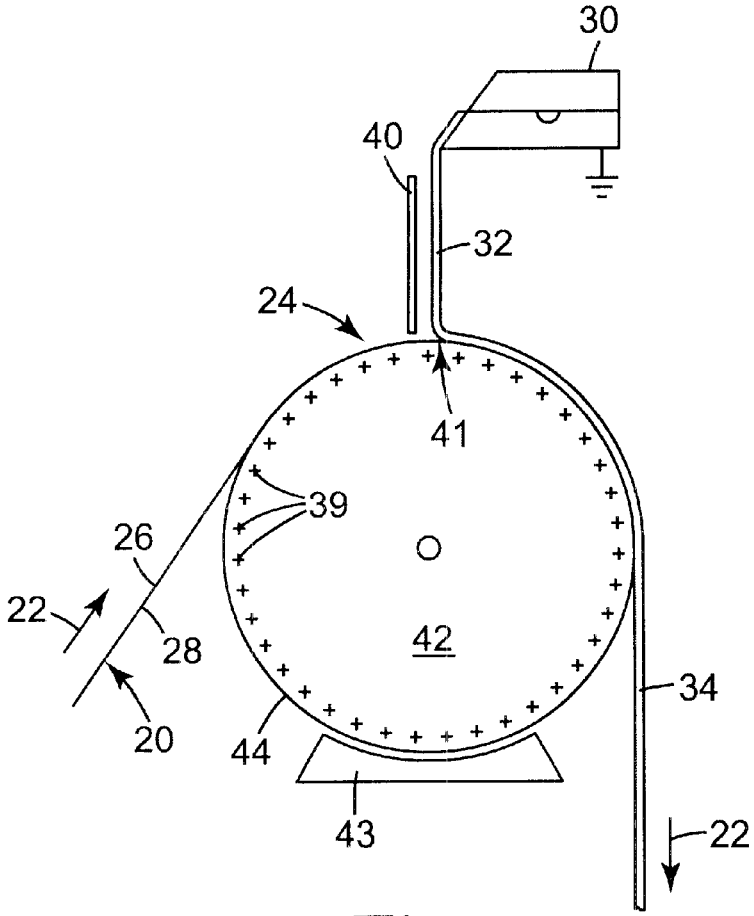
Fig. 2 PRIOR ART
FIG. 2 is a schematic view of a known electrostatic coating apparatus where charges are delivered to the moving web from a backing roll under the moving web at the coating station.
Figure 4:
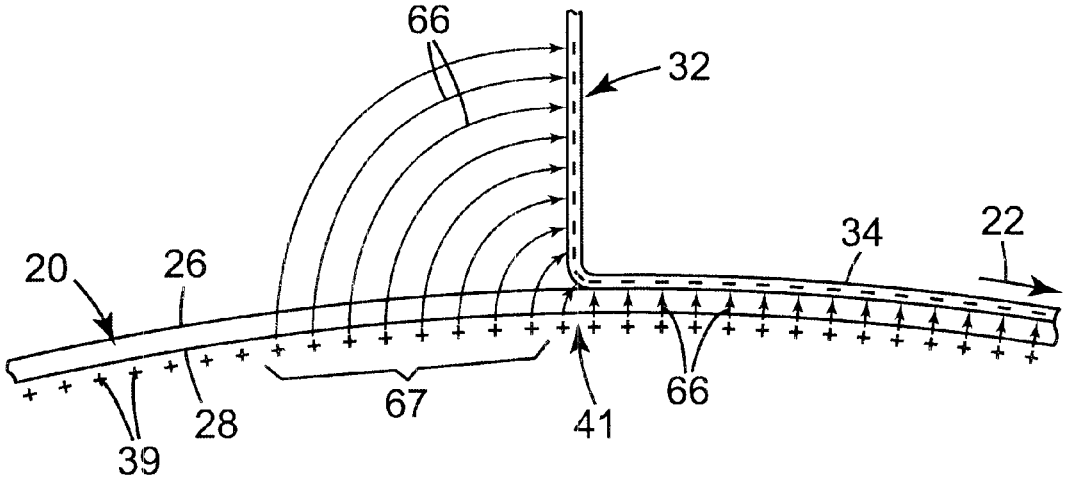
Fig. 4 PRIOR ART
FIG. 4 is an enlarged schematic view of a portion of FIG. 2 illustrating the applied electrostatic charges and lines of force.

FIG. 4 is an expanded view of the prior art system in FIG. 2, showing the lines of force 66 generated by the electrostatic charges 39 relative to the coating fluid 32. For curtain coating applications, the desired wetting line is typically the gravity-determined coating fluid wetting line when the web is stationary (or initial coating fluid wetting line when the web is stationary) and, as illustrated in FIGS. 2 and 4, is the top dead center of the charged roll. However, other wetting line positions are common and depend on the type of coating die, fluid properties, and web path.

The lines of force 66 indicate that for a charged roll (like the roll 42 in FIG. 2) the forces are not well focused and the charges are exerting forces on the coating fluid substantially upweb of the wetting line (e.g., on upweb area 67). For example, for charged rolls that are larger than 7.5 cm (3 in) in diameter, the charges exert forces on the coating fluid substantially upweb from the desired wetting line. However, as the delivery of charges to the web becomes more focused, say for a one-inch diameter roll given the same potential, the charges do not exert functional forces on the coating fluid substantially upweb from the desired wetting line that adversely affect the wetting line uniformity (i.e., the charges on the web are ineffective upweb relative to the coating fluid).

Figure 5:
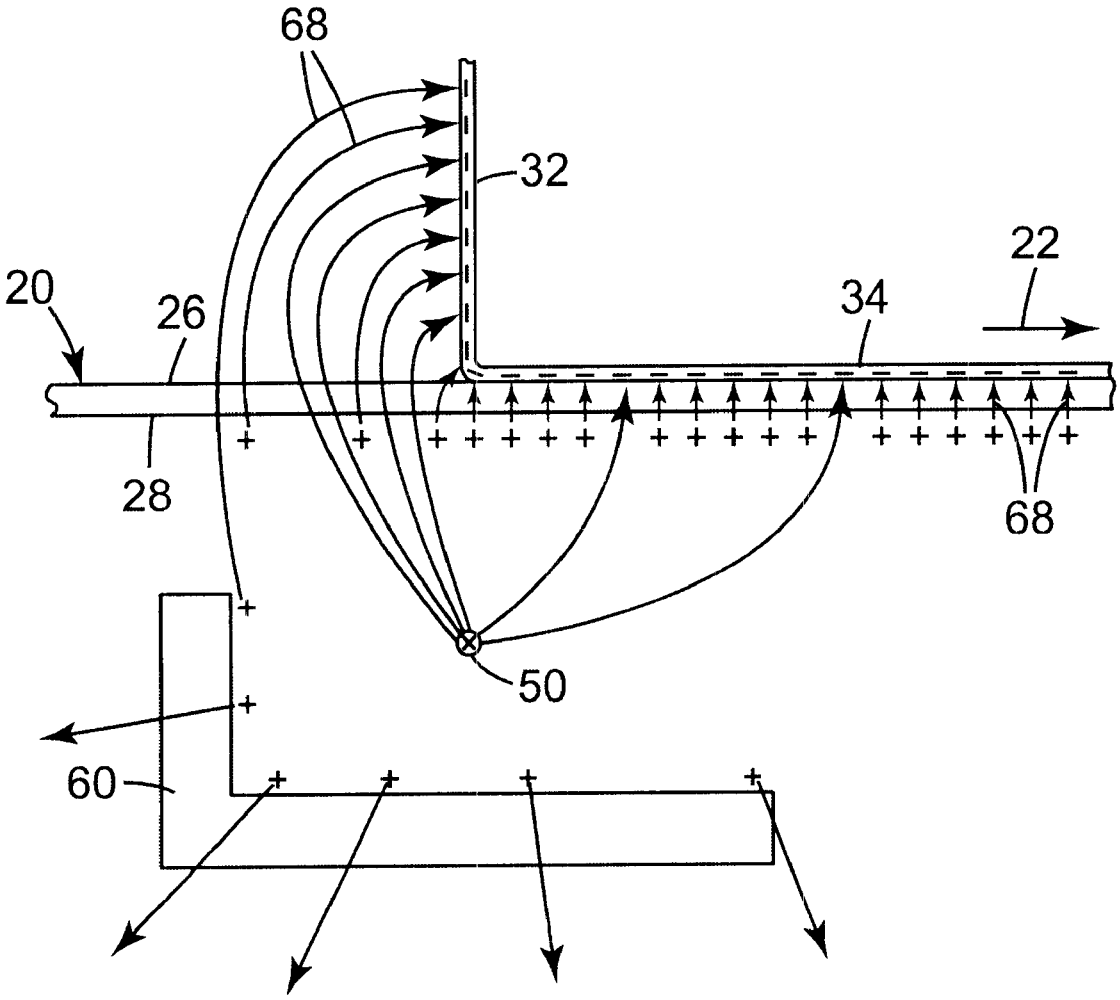
FIG. 5 is an enlarged schematic view of a portion of FIG. 3 illustrating the applied electrostatic charges and lines of force during coating operations.

FIG. 5 is an expanded view of the inventive system in FIG. 3, showing where the charges transferred to a second surface on the second side of the web are more focused beneath the coating fluid and web contact line. In this case, the lines of force 68 are more focused, thus creating a more sharply defined and linear wetting line, and which stabilizes the wetting line by tending to lock it into position across the web travel path. Further focusing techniques, such as the shield 60 shown in FIG. 3, can also improve focusing. Viscous and elastic fluids can require a higher degree of focusing since variations in contact line uniformity can cause larger variations in coating thickness, as compared to a lower viscosity and elasticity fluid.

Figure 6:
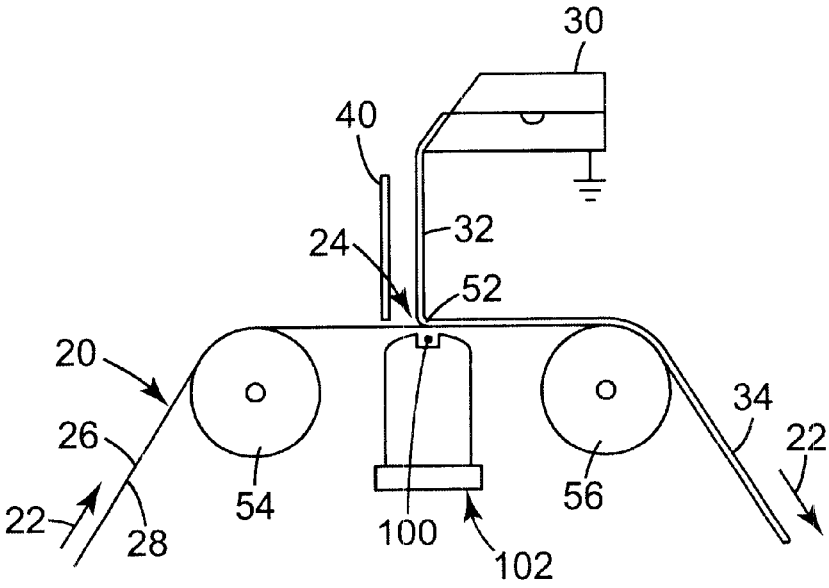
FIG. 6 is a schematic view of another embodiment of the electrostatically assisted coating apparatus of the present invention, where an air bearing assembly houses a corona wire.
Figure 7:
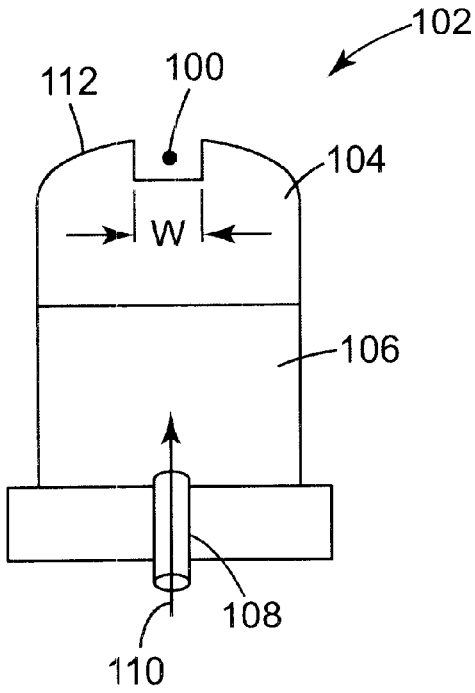
FIG. 7 is an enlarged schematic view of the air bearing assembly with the corona wire of FIG. 6.

FIGS. 6 and 7 illustrate yet another embodiment of the electrostatically assisted coating apparatus of the present invention. As illustrated in FIGS. 6 and 7, a laterally extending electrode 100 extends along the second side 28 of the web 20. The electrode 100 may be formed from, for example, a continuous corona wire, discretely spaced needle points, a brush, or any member with a sharp edge that can generate a corona discharge. Preferably, the electrode 100 is disposed within an adjacent web air bearing 102, which can act as an upweb shield and downweb shield. The air bearing 102 stabilizes the web position and web vibrations which otherwise can have an adverse effect on coating stability and uniformity. The air bearing 102 preferably has a porous membrane 104 (such as, porous polyethylene) in fluid communication with an air manifold chamber 106. Pressurized air is provided to the air manifold chamber 106 via one or more suitable inlets 108, as indicated by arrow 110. The air flows through the air manifold chamber 106 and into the porous membrane 104. The porous membrane 104 has a relatively smooth and generally radiused bearing surface 112 positioned adjacent the second side 28 of the web 20. Air exiting the bearing surface 112 supports the web 20 as it traverses the coating station 24 and electrode 100, and creates a media spacing (i.e., air) between the electrode 100 and the second side 28 of the web 20. While an active air bearing is described, a passive air bearing (using only the air boundary layer on the second side of the web as the bearing media) can work at sufficiently high web speeds. Other means may alternatively be used, for example, known web floatation devices that are commonly used in drying technologies, such as airfoil devices.

Like the arrangement of FIGS. 3 and 5, the embodiment of FIGS. 6 and 7 forms a narrow distribution of electrostatic field lines adjacent the fluid wetting line which constrains the coating fluid/web wetting line to a straight line at a desired location. The electrostatic effects increase the coating fluid wettability on the web and "lock" the coating fluid/web contact line into a stable line extending laterally across the web.

Comparative quantitative analyses were conducted to evaluate the advantages of the inventive electrostatic assisted coating arrangement. In one series of experiments, the web 20 ranged from a 0.013 cm (0.005 inch) thick paper backing to a 0.0076 cm (0.003 inch) thick paper liner with a release layer on the second side, and the coating fluid 32 was a waterbased dispersion with a viscosity of approximately 850 centipoise. The flow rate of the coating fluid in the curtain was set so that at a web speed of 111.25 m/min. (365 ft/min), we would achieve about 10.6 micron (0.00042 in) dry coating thickness. Different curtain heights were evaluated, from 5.72 cm (2.25 inch) down to 0.64 cm (0.25 inch). Curtain coating this fluid without an electrostatic assist resulted in very low line speeds with air entrainment and curtain breakage occurring if web speeds were increased. Several electrostatic systems were tested to determine the best method to curtain coat this fluid. Unless otherwise noted voltages listed are positive in polarity. Using a system like that shown in FIG. 2, but with a conductive powered roll and a curtain height of about 1.27 cm (0.5 in), the maximum web speed that could be obtained without air entrainment was 15.25 m/min. (50 ft/min) without electrostatics. At that condition, the curtain contact line was deflected about 2.5 cm (1 inch) downweb of the top dead center position on the support roll. Further increases in line speed caused breakage of the curtain. As the voltage of the energized support roll was increased to allow higher web speeds, arcing through the web would occur at about 2,500 volts. A web speed of 112.78 m/min. (370 ft/min.) was attained at 2,000 volts before dielectric breakdown of the web. When arcing occurred, the beneficial effect of the electrostatics greatly diminished, which in turn limited the web speed. Using a polymer carrier web or belt, less arcing would occur, however residual web or belt charges could cause coating uniformity problems. Precharging the web in a manner similar to that shown in FIG. 1 was also investigated, with very little ability to increase web speed when using a paper backing as the web. Charging a rubber or ceramic covered support roll was also evaluated. With this type of system, web speeds up to 137.16 m/min. (450 ft/min.) were attainable with the corona charging device set at 9 to 12 kilovolts. However, with this system, charge non-uniformities on the incoming web or on the roll surface can affect the linearity of the contact line and contact line stability.

Using the inventive arrangement illustrated in FIG. 3, excellent contact line stability and linearity were observed. The corona discharge wire was a 0.0152 cm (0.006 in) diameter tungsten wire located typically 1.9 cm (0.75 in) below the second side 28 of the web 20. The power supply was an EH series high voltage power supply manufactured by Glassman High Voltage, Inc. of Whitehouse Station, N.J. A Delrin™ upweb side shield 60 was spaced 1.27 cm (0.5 in) from the corona discharge wire 50. Web speeds up to 198.12 m/min. (650 ft/min.) were observed, using 15 kilovolts. The curtain flow rate was doubled and maximum web speeds of 618.16 m/min. (1700 ft/min.) were attained with 17 kilovolts. Current usage was lower than observed with a powered support roll system, and was generally less than 15 microamps per inch of width. This system was the most aggressive system used and was the least sensitive to process variations.

The utility of the inventive arrangement was further illustrated in this system when a large lateral discontinuity was purposely created in the electrostatic field created by corona wire 50. A 0.15 cm (0.06 inch) wide strip of Scotch™ Super 33+ Vinyl Electrical Tape was placed on the wire to simulate a severely contaminated wire. At a web speed of about 635 cm (250 ft/min.) and 8 kilovolts on the corona wire, the contact line remained fairly linear, with a 0.32 cm (0.125) inch width of the curtain being deflected downweb by only 0.076 cm (0.030 inch) over the area of the tape strip on the wire, with only a narrow line of air entrainment occurring at the deflection point (the application of higher voltages to the wire would tend to reduce or eliminate the air entrainment). Apparently, electrostatic charges generated from the wire adjacent to the tape strip migrate to the second side of the web directly over the tape strip, thus creating the requisite electrostatic attractive force between the web and coating fluid in the coating area. The inventive non-contact corona charging system (e.g., as shown in FIG. 3), creates an adaptive system that applies a substantially uniform cross-web charge distribution on the second side of the web at the coating fluid wetting line, but with a fairly abrupt decrease in second side charges upweb of the wetting line.

Figure 8:
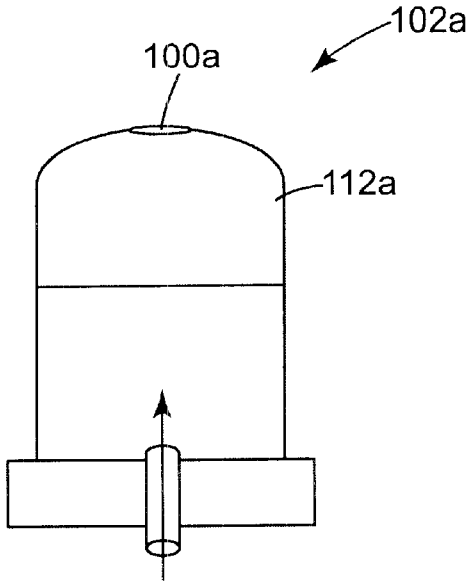
FIG. 8 is an enlarged schematic view of an alternative air bearing assembly with a conductive strip.

In another test, the web 20 was a 0.0036 cm (0.0014 inch) polyester backing which was coated using an inventive system apparatus similar to that shown in FIG. 6. In this test, an air bearing 102*a* (FIG. 8) was used, which supported an electrode 100*a*. The electrode 100*a* was a laterally disposed conductive strip about 0.94 cm (0.37 inch) long (in direction of web travel) with upweb and downweb edges of the conductive strip taped to the bearing surface 112*a* of the air bearing 102*a* (to prevent corona discharges at those edges). The coating fluid 32 was a waterbased emulsion with a viscosity of approximately 800 centipoise, and the flow rate was adjusted to achieve a dry coating thickness of about 19 microns (0.00075 in.) at a web speed of 304.8 m/min. (1000 ft/min). With a coating curtain height of 13.34 cm (5.25 inch) the maximum web speed attained (before coating uniformity degradation) was about 121.92 m/min. (400 ft/min.) without using electrostatics. With the electrostatic system activated, the maximum web speed attained was about 487.68 m/min. (1600 ft/min.), at an electrode voltage of 5 kilovolts. Running the web at higher speeds would cause air entrainment bubbles. However, a primary concern with the system was that very high levels of current were required (at about 500 microamps per inch of coating width). As voltage on the electrode 100*a* was increased to allow higher web speeds, higher levels of current were required and arcing could occur.

The inventive electrostatic assisted coating apparatus of FIG. 3 was used with the same coating fluid and polyester substrate as the above example (the web 20 was a 0.0036 cm (0.0014 inch) polyester backing, and the coating fluid 32 was a waterbased emulsion with a viscosity of approximately 800 centipoise). The coating curtain flow rate was adjusted to yield a dry coating thickness of 19 microns (0.00075 inch) at a web speed of 914.1 m/min. (3000 ft/min.), with the coating curtain height being 19.37 cm (7.625 inch). A Delrin™ upweb side shield 60 was spaced 0.635 cm (0.25 in) from the corona discharge wire 50. A downweb shield for this test was also used and was spaced 0.635 cm (0.25 in) from the corona discharge wire 50. With the electrostatic system activated at a voltage of 19 kilovolts, a web speed of 914.1 m/min. (3000 ft/min.) was attained with a linear and stable wetting line and no air entrainment. The current draw was generally as low as 10 microamps per inch.

In use, the electrostatically assisted coating system of FIG. 3 was more aggressive than expected and the coating wetting line was linear and stable. The interaction between the grounded conductive coating fluid 32 and the corona discharge wire 50 creates an abrupt and intense application of electrical charges 58 on the second side 28 of the web 20 along a desired lateral fluid wetting line (see, e.g., FIG. 5). Using upweb shielding further increases the abruptness of the field. The attraction of a high density of charges to the second side 28 of the web 20 opposite where the coating fluid 32 contacts the first side 26 of the web 20 (and an increasingly lower density of charges in an upstream direction), creates extremely focused electrostatic field lines. The linearity of the contact line was much better with the coating system of FIG. 3 than with a known dielectric backing roll system such as illustrated in FIG. 2. The FIG. 3 arrangement is flexible and self-compensating and creates an electrostatic focused electrostatic field gradient. This system is simpler, safer (since lower current levels are used), and less likely to suffer the effects of a dielectric breakdown of the web as compared to known systems.

The system of FIG. 3 also eliminates the high current requirements when using waterbased or conductive fluids. Typically, a current of more than 98.43 microamps per cm (250 microamps per inch) width (of web) can be required when using a conductive energized backing roll for known electrostatically assisted coating when coating at very high web speeds. However, with the corona discharge wire of FIG. 3, the current requirement for electrostatic charge generation is generally reduced to 9.843 microamps per cm (25 microamps per inch) width or less. Thus, the FIG. 3 system has a very low shock hazard, and accordingly, is safer. To further enhance this low shock system, suitable size resistors (or other current limiting systems) can be used in series with the high voltage supply to the corona discharge wire. This reduces the maximum current flow in the event of a discharge and spreads the capacitive energy of the power supply over a longer time span (reducing the peak current in a discharge).

In the inventive electrostatic assisted coating apparatus of the FIG. 3 system, the corona discharge wire 50 is closely spaced from the second side 28 of the web 20. The corona discharge wire 50 should be spaced from the second side 28 of the web 20 to provide an air gap to obtain an effective corona discharge effect. The wire-to-web spacing depends on a number of factors, including, for example, web thickness and dielectric strength, coating fluid conductivity and web speed. The spacing is preferably in the range of 0.08 cm to 7.6 cm (0.031 inch–3 inch), and more preferably in the range of 1.58 cm to 1.9 cm (0.625 inch to 0.75 inch).

The spacing of the upstream side shield 60 from the corona discharge wire 50 is preferably 0.15 cm to 7.7 cm (0.06 inch to 3.0 inch). A side shield can also be provided a similar distance downstream from the corona discharge wire 50 to further limit the loss of charges from the corona discharge effect. This prevents unnecessary charges from going downstream of the desired coating wetting line.

The corona discharge wire 50 can be positioned directly under the initial wetting line of the coating fluid 32 on the web 20. Web movement, surface tension, boundary layer effects on the first side of the web 20 and the elasticity of the coating fluid 30 can cause the coating wetting line to shift downweb. Because of the strong electrostatic attraction that can be achieved with this invention, the location of the corona discharge wire 50 will tend to dictate the operational location of the coating wetting line when the coating assist corona discharge wire 50 is activated. Thus, the location of the corona discharge wire 50 (upstream or downstream from the initial coating wetting line) can cause a corresponding movement of the wetting line, as it aligns itself with the opposed attracted electrical charges. Preferably, the corona discharge wire 50 is positioned no more than 2.54 cm (1.0 in) upstream or downstream from where the initial wetting line would fall if unaffected by charges.

Figure 9:
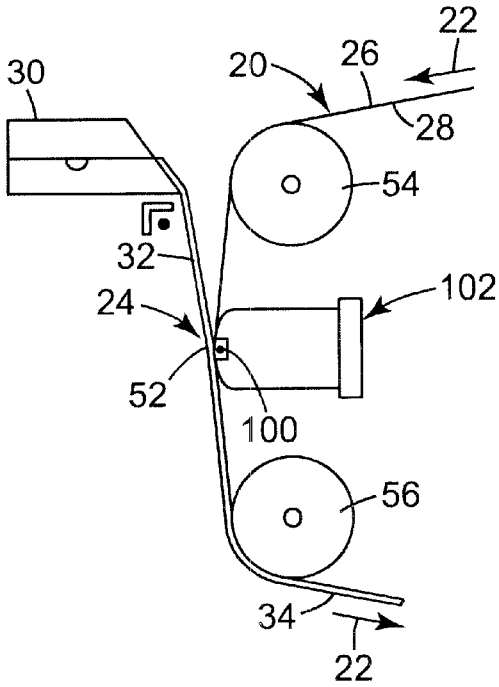
FIG. 9 is a schematic view of another embodiment of the electrostatically assisted coating apparatus of the present invention, illustration one application of its use for tangential curtain coating.

The use of a corona discharge wire spaced from the web adjacent the wetting line also lends itself well to tangential fluid coating. A tangential coating apparatus using an air bearing to house an electrostatic coating assist corona wire is shown in FIG. 9 (using an air bearing/electrode assembly such as illustrated in FIG. 7). The width "w" of the channel (FIG. 7) in the air bearing 102 housing the corona wire is preferably 0.635 cm to 1.9 cm (0.25 in to 0.75 in) but can be larger or smaller. Tangential curtain coating is generally capable of running coating fluids with higher extensional viscosities than is possible with horizontal curtain coating geometries. The tangential coating arrangement of FIG. 9 yields less of a coating curtain directional change at the wetting line and has the additional production advantage that if the web 20 breaks, the corona discharge wire 50 is not as readily contaminated with coating fluid 32. Modifying the arrangement to include a continuously moving or intermittently moving corona discharge wire would ensure a clean wire. Additionally, an air flow around the wire to keep particles from attaching to the wire (which is desirable in terms of long term production durability) can be used.

Figure 10:
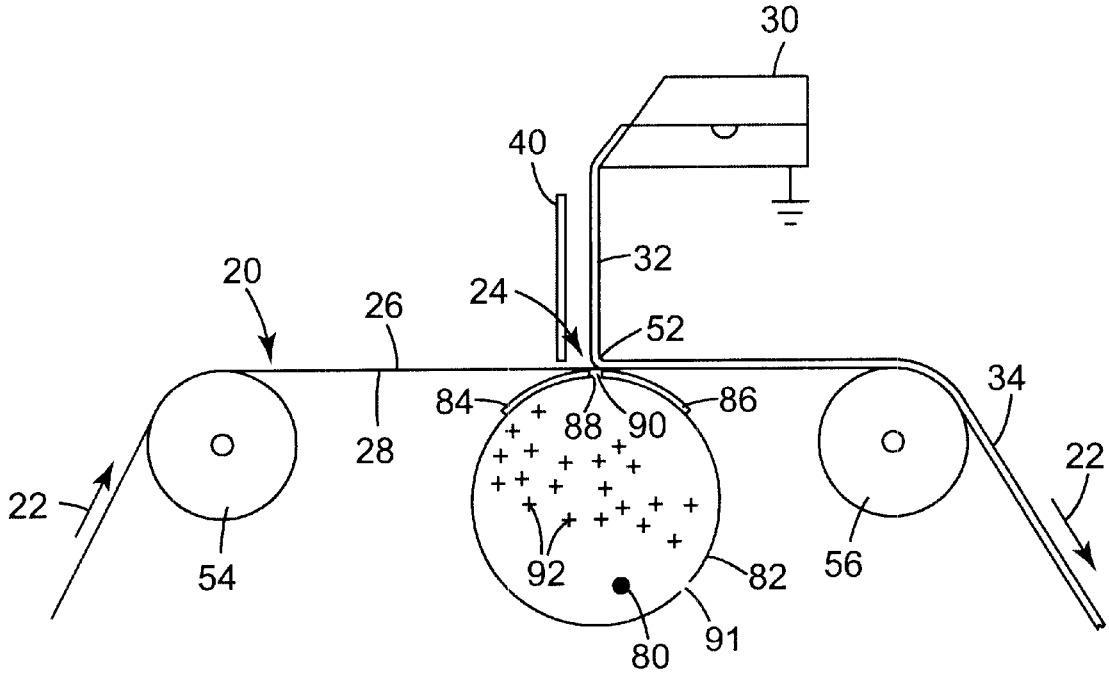
FIGS. 10 and 11 are schematic views of other embodiments of the electrostatically assisted coating apparatus of the present invention showing remote locations for the source of electrical charges.

FIG. 10 illustrates an alternative inventive embodiment of the focused web charge electrostatically assisted coating apparatus. In this embodiment, the electrostatic charges applied to the web 20 are created by a charge generator remotely spaced from the web, and then are transferred by a suitable medium to the second side 28 of the web 20. Like the system of FIG. 3, this version defines the position of the coating wetting line, minimizes the air boundary layer, and enlarges the acceptable process parameters.

In FIG. 10, a laterally extending corona discharge wire 80 is disposed within a drum 82. The corona discharge wire 80 is remotely spaced at least 7.62 cm (3.0 in) from the web 20. The drum 82 may be conductively shielded adjacent the web 20, such as by shields 84, 86. The shields 84, 86 may be grounded or elevated to a desired potential. The shields 84, 86 are separated by a laterally extending slot 88, and the cylindrical wall of the drum 82 has a laterally extending slot 90 which is generally aligned with the slot 88. Thus, the interior of the drum 82 is open to the exterior through the slots 88, 90. The drum 82 can also incorporate an inlet 91 for air flow through the drum 82. Ions or electrical charges 92 discharged from the corona discharge wire 80 are contained within the drum 82 and can only escape the drum 82 (adjacent its upper portion) through the slots 88, 90. The upweb edge of the slot 88 is typically aligned to be adjacent the initial coating wetting line 52. The charges 92 from the corona discharge wire 80 are only applied to the second side 28 of the web 20 via the slots 88, 90. There is no contact between the charge generator and the web 20. This system creates an abrupt and highly focused laterally disposed application of charges 92 to the web 20, even though those charges 92 are generated remote from the web 20 without any contact between the charge generator and the web 20. While a drum is shown, other geometries for application of charges remotely created are also contemplated, such as a rectangular or triangular structure with the current supplied by an ion blower or charged wire.

Figure 11:
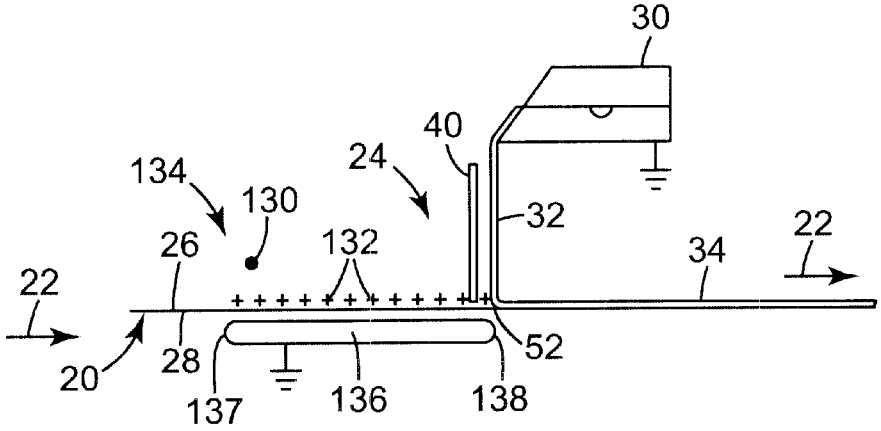

Another embodiment of the electrostatically assisted coating apparatus of the present invention is illustrated in FIG. 11, and shows another means for providing electrostatic charges at a position remote from the coating station 24. A laterally extending electrical charge applicator (such as a corona discharge wire 130) is spaced upweb from the coating station 24, preferably on the first side 26 of the web 20. The corona discharge wire 130 (or other suitable electrode) applies electrostatic charges 132 to the first side 26 of the web 20 at a charge application station 134 spaced longitudinally upstream from the coating station 24. In this system, a grounded surface or plate 136 is aligned along and spaced from the second side 28 of the web 20, upweb from the coating station 24. The corona wire 130 may be positioned at a point above the grounded plate 136 (as shown) or may be at a position further upstream from a leading end 137 of the grounded plate 136. A trailing end 138 of the exposed grounded plate 136 ends essentially slightly upweb of the initial lateral coating wetting line 52. The location of the trailing edge 138 will, in large part, establish the wetting line when electrostatics are activated. Preferably, the trailing edge 138 is within an inch (+/−) of the initial wetting line. The plate 136 may extend downweb past the initial wetting line as long as it is effectively shielded to define a trailing edge of the plate. The corona discharge wire 130 applies electrical charges 132 to the first side 26 of the web 20. The electrostatic attraction of the charges 132 on the web 20 to the plate 136 is greater than the attraction of the charges 132 to the grounded coating fluid 32 (because of the proximity of the plate to the web) until the charges 132 become closer to the grounded fluid 32 than the grounded plate 136, and especially at the trailing edge 138 of the plate 136 (which creates the more focused field). At that point, the grounded fluid 32 is then drawn to the charges 132 on the web 20, thereby electrostatically assisting in defining the wetting line in the highly focused manner of the present invention and its attendant advantages, as described above. The upweb electrostatic charges 132 are "masked" or rendered ineffective as attractive charges relative to the coating fluid 32 until near the trailing end 138 of the grounded plate 136 (at which point the electrostatic charges 132 on the web 20 become effective (i.e., attractive) charges relative to the coating fluid 32 to electrostatically assist in defining the wetting line in accordance with the herein stated principles of the invention). In addition, while the plate 136 is preferably grounded, it may also suffice to provide a plate or surface which has a slightly elevated potential (so long as it serves the purpose of rendering the electrical charges deposited on the web ineffective until they reach the coating fluid contact line). Preferably, the potential of the plate is electrically opposite the potential of the charges 132. In addition, although FIG. 11 illustrates the use of a corona discharge wire 130 to deliver charges 132 to the first side 26 of the web 20, the charges could be applied to the web by any suitable charge delivery scheme, and could even be deposited on the second side 28 of the web 20. Regardless of how the web 20 is charged, the invention renders those charges effective for electrostatic attraction purposes only substantially at and downweb of the fluid wetting line.

Comparative coating runs were conducted (using glycerin as the coating fluid) to demonstrate the feasibility and utility of masking charges to create more focused fields. The system used was similar to the system of FIG. 11, except that the web precharging step was accomplished on an idler roll upweb of the coating station. The gap between the web charging wire and the 7.62 cm (3 inch) diameter idler roll was about 1.8 cm (0.7 inches). The grounded plate was aluminum, with the surface thereof facing the web being 10.8 cm (4.25 inches) long and 30.5 cm (12 inches) wide. The gap between the grounded plate and the web at the coating station was about 0.32 cm (0.125 inch). The edges of the plate were covered with Scotch™ Super 33+ Vinyl Electrical Tape to prevent corona discharges from the edges of the plate. The die position was adjusted such that a vertically falling curtain of coating fluid would contact the web at the leading edge of the tape at the taped trailing edge of the grounded plate with no electrostatics and a stationary web. The polyester web was 30.48 cm (12 inch) wide with a thickness of 0.00356 cm (0.0014 inches). The die was a slide curtain die with a 25.4 cm (10 inch) coating width and a die slot thickness of 0.076 cm (0.030 inch). The coating fluid was glycerin (99.7% pure) from the Milsolv® Minnesota Corporation. The curtain height was set at 1.9 cm (0.75 in). The measured viscosity of the coating fluid was about 1060 centipoise and its surface tension was about 46 dyne/cm. The flow rate of the glycerin was set to attain a wet coating thickness of 51 microns (0.002 inches) at a web speed of 30.5 m/min. (100 ft/min.).

Without electrostatics, at 1.53 m/min (5 feet/min), the wetting line aligned itself downweb of the vertical curtain position by about 2.3 cm (0.9 inches), with large amounts of entrained air. Higher speeds would further move the contact line downweb and cause curtain breakage. With electrostatic precharging of the web at 12 kilovolts and no charge masking plate, the wetting line moved upweb but was very nonlinear and had large unstable ribs, with a spacing between the ribs of about 2.5 to 5 cm (1 to 2 inches). The ribs extended upweb of the vertical position by about 0.64 cm (0.25 inches) and downweb by about 1.27 (0.5 inches), giving linearity of about plus or minus 0.97 cm (0.38 inches). Lower applied voltages resulted in the wetting line moving further downweb, while higher voltages moved the contact line further upweb and created a more unstable wetting line. Increasing the web speed caused greater instability and curtain breakage.

Using the same web precharging system but also utilizing the grounded plate to mask the incoming upweb charges resulted in a substantial improvement. With the same 12 kilovolt upweb precharging, the wetting line was about at the vertical position with a linearity of plus or minus 0.32 cm (0.125 inches) and stable, at a web speed of 1.53 m/min (5 feet/min). Further increases in voltage did not cause the wetting line to move upward and resulted in increased linearity. This system also allowed the web speed to be increased. At 24.4 m/min (80 feet/min) the wetting line was stable about at the vertical position with a visual linearity of approximately plus or minus 0.08 cm (1/32 inch) at 20 kilovolts. Entrained air of about 0.127 cm (0.050 inch) diameter and less was noticed at this speed.

For comparison purposes, the system as shown in FIG. 3 was used. The web precharging and grounded charge masking plate were not used, otherwise the system was the same as the last test, with the curtain height being about 1.9 cm (0.75 inches). Using a voltage of 12 kilovolts on the electrode (corona discharge wire), and a web speed of 1.53 m/min (5 ft/min), the wetting line was 0.32 (0.125 inches)

downweb of the vertical position and was linear and stable with no air entrainment. At both 15 kilovolts and 20 kilovolts the wetting line position was vertical (directly above the wire). The web speed was then increased to 30.48 m/min (100 ft/min) at 20 kilovolts, and the wetting line remained at the vertical position with a linear and stable wetting line and no visual air entrainment. Measurements of the wetting line position and linearity of the contact line were generally estimated visually.

These tests demonstrate that the systems of FIGS. 3 and 11 can focus the fields to create a linear and stable wetting line and allow higher coating speeds. Additionally, it was seen that the system of FIG. 3 was more aggressive and appeared to have wider operating windows. The system of FIG. 11 can be functional where a less aggressive electrostatic assist is required.

Masking charges is yet another way of creating the more focused fields. Numerous other ways are also feasible, including utilizing field shaping techniques using opposing fields or charge sources or any system which shapes the field.

FIGS. 3, 6, 9, 10, and 11 illustrate but some of the many variations of an apparatus for applying electrical charges to the second side of the web at the coating station. Numerous other arrangements for achieving the improved process conditions of the present invention would be apparent to one skilled in the art as falling within the spirit and scope of this disclosure. A significant advantage of generating the electrical charges at a location remote from the coating station, and then transferring those charges through a fluid medium (like air) to the web, is a simplification of the structure for ease of maintenance and operation. The electrical charge generator need not be adjacent the coating fluid applicator or even at the coating station. Moreover, if the web breaks, contamination of the electrical charge generator by coating fluid can be minimized or avoided. These advantages lead to operational time savings and enhanced productivity.

Also incorporated herein by reference is co-assigned U.S. patent application Ser. No. 09/544,592, filed Apr. 6, 2000, on Electrostatically Assisted Coating Method And Apparatus With Focused Electrode Field, by John W. Louks, Sharon S. Wang and Luther E. Erickson (Attorney Docket No. 55075USA2A). The cited patent application discloses, among other things, various embodiments and examples of methods and apparatus for electrostatically assisted coating with an effective electrical field substantially at or downstream of the fluid wetting line. The electrical field in some embodiments of the cited patent application primarily emanates from an electrical field applicator on the second side of the substrate rather than electrical charges transferred to the substrate.

Various changes and modifications can be made in the invention without departing from the scope or spirit of the invention. For example, any method may be used to create the focused web charge field. In addition, as mentioned above, numerous coating processes (including even roll coating) can benefit from more focused electrostatic fields. For example, for kiss coating, the focused field above the initial wetting line can improve the aggressiveness, wettability and process stability.

The electrostatic focused field can also be made to be laterally discontinuous, to coat only particular downweb stripes of the coating fluid onto the web, or can be energized to begin coating in an area and de-energized to stop coating in an area, so as to create an island of coating fluid on the web or patterns of coating fluid thereon of a desired nature. The electrostatic field can also be made to be non-linear, for example by a laterally non-linear corona source, so as to create a non-linear contact line and a non-uniform coating. Thus, if an electrode has a downweb curvature in a particular laterally disposed area, the coating in that area can be thicker as compared to adjacent areas.

All cited materials are incorporated into this disclosure by reference.

What is claimed is:

1. An apparatus for applying a coating fluid onto a substrate having relative longitudinal movement with respect to a coating station of the apparatus, wherein the substrate has a first surface on a first side thereof and a second surface on a second side thereof, and wherein the apparatus comprises:

means for dispensing a stream of coating fluid onto the first surface of the substrate to form a fluid wetting line along a laterally disposed fluid-substrate contact area at the coating station; and an electrical charge applicator extending laterally across the second side of the substrate and aligned generally opposite the fluid wetting line on the first surface of the substrate, the applicator providing electrical charges on the second side of the substrate which define a focused electrical field that creates an electrical force on the fluid which is effective substantially at and downstream of the fluid wetting line, without being effective substantially upstream of the fluid wetting line.

2. The apparatus of claim 1 wherein the electrical charge applicator is spaced from the second surface of the substrate at the fluid coating station for applying electrical charges onto the second surface of the substrate, wherein the charges are transferred to the second surface through a fluid medium.

3. The apparatus of claim 1 wherein the electrical charge applicator comprises at least one of a laterally extending charged wire, a sharp-edged member, a sharp-edged conductive sheet, a series of needles, a brush, or a jagged knife edge.

4. The apparatus of claim 1 wherein the electrical charge applicator comprises:

an electrical charge source, for producing the electrical charges as first electrical charges, distant from the second surface of the substrate; and a fluid medium disposed between the electrical charge source and the second surface of the substrate to transfer the first electrical charges from the electrical charge source to a laterally disposed charge application zone adjacent the second surface of the substrate at the fluid wetting line and to apply the first electrical charges onto the second surface of the substrate.

5. The apparatus of claim 4 wherein the electrical charge source is remotely spaced at least 7.62 cm from the substrate.

6. The apparatus of claim 4 wherein the electrical charge applicator is uniformly spaced from the second surface of the substrate.

7. The apparatus of claim 1, and further comprising:

an air bearing extending laterally across the substrate adjacent the electrical charge applicator for supporting and aligning the second side of the substrate relative to the electrical charge applicator.

8. The apparatus of claim 1, and further comprising:

an electrostatic field barrier disposed near the electrical charge applicator and the substrate to shield portions of the substrate that are upstream from the fluid wetting line from electrical charges produced by the electrical charge applicator.

9. The apparatus of claim 1 wherein the means for dispensing comprises a coating fluid dispenser selected from the group consisting of a curtain coater, a bead coater, an extrusion coater, a dispenser for carrier fluid coating, a slide coater, a knife coater, a jet coater, a notch bar, a roll coater, and a fluid bearing coater.

10. The apparatus of claim 1 wherein electrical charges from the electrical charge applicator are first electrical charges that have a first polarity, and further comprising:

means for applying second electrical charges to the stream of coating fluid, the second electrical charges having a second opposite polarity from that of the first electrical charges.

11. The apparatus of claim 1 wherein the means for dispensing is oriented to dispense the stream of fluid onto the substrate at an angle of from 0 degrees through 180 degrees.

12. An apparatus for applying a coating fluid onto a substrate having relative longitudinal movement with respect to a fluid coating station of the apparatus, wherein the substrate has a first surface and a second surface, the apparatus comprising:

a coating fluid dispenser aligned to dispense a stream of coating fluid onto the first surface of the substrate to form a fluid wetting line along a laterally-disposed fluid-substrate contact area at the fluid coating station; and means for exposing effective electrical charges on the substrate to the fluid only at a location on the substrate that is substantially at and downstream of the fluid wetting line without being effective substantially upstream of the fluid wetting line.

13. The apparatus of claim 12, and further comprising:

an electrical charge applicator disposed to deposit the electrical charges onto at least one of the first or second surfaces of the substrate at a location upweb from the fluid coating station.

14. The apparatus of claim 13, wherein the means for exposing comprises:

a mask to make the electrical charges on the substrate ineffective until the electrical charges are at least substantially at the fluid wetting line.

15. The apparatus of claim 14 wherein the mask is a grounded surface which is adjacent and spaced from the substrate, and which is exposed along the substrate from a trailing edge of the grounded surface just upweb of the fluid wetting line to a leading edge of the grounded surface spaced upweb further therefrom.

16. The apparatus of claim 15 wherein the electrical charge applicator extends laterally relative to the substrate and is aligned opposite a portion of the grounded surface, with the substrate disposed between the electrical charge applicator and said portion of the grounded surface.

17. The apparatus of claim 13, wherein the mask is an elevated potential surface having an opposite polarity to the electrical charges, the elevated potential surface being adjacent and spaced from at least one of the first or second surfaces of the substrate, and the elevated potential surface being exposed along the substrate from a trailing edge of the elevated potential surface just upweb of the fluid wetting line to a leading edge of the elevated potential surface spaced upweb further therefrom.

* * * * *

UNITED STATES PATENT AND TRADEMARK OFFICE

CERTIFICATE OF CORRECTION

PATENT NO. : 6,666,918 B2
DATED : December 23, 2003
INVENTOR(S) : Louks, John W.

It is certified that error appears in the above-identified patent and that said Letters Patent is hereby corrected as shown below:

Column 1,
Line 10, after "METHOD" delete "AND APPARATUS".
Line 13, after "Benson." insert -- The aforementioned U.S. Application is fully incorporated by reference into the present application. --

Column 19,
Line 34, after "line" insert -- , --.

Signed and Sealed this

Twenty-first Day of June, 2005

JON W. DUDAS
*Director of the United States Patent and Trademark Office*